United States Patent [19]

Powell et al.

[11] 3,988,809

[45] Nov. 2, 1976

[54] SHOULDER STRAP RETAINER

[76] Inventors: Robert B. Powell; Elizabeth S. Powell, both of 3000 Grand Ave., Des Moines, Iowa 50312

[22] Filed: Feb. 28, 1975

[21] Appl. No.: 554,393

[52] U.S. Cl. ..... 24/85 R

[51] Int. Cl.[2] ..... A44B 9/00

[58] Field of Search ..... 24/73 LF, 49 CF, 49 K, 24/49 A, 49 CP, 85 A, 85 B, 86 A, 86 B, 86 R, 76, 3 H, 3 K, 3 L, 3 F, 49 P, 85 R, 259 A; 224/5 P; 2/2

[56] References Cited

UNITED STATES PATENTS

| | | | |
|---|---|---|---|
| 686,090 | 11/1901 | Krekel | 24/49 A UX |
| 1,151,696 | 8/1915 | Levin | 224/5 P UX |
| 1,531,915 | 3/1925 | Fitzgerald | 24/73 LF |
| 1,998,160 | 4/1935 | Keilhamer et al. | 24/73.1 |
| 2,004,305 | 6/1935 | Bopea | 24/73 LF |
| 2,084,738 | 6/1937 | Manker | 24/49 A |
| 2,169,633 | 8/1939 | Fulton | 24/85 R |
| 2,792,607 | 5/1957 | Packham | 24/85 R |
| 2,893,086 | 7/1959 | Parker | 24/49 CP |
| 2,932,869 | 4/1960 | Neubig | 24/85 R |
| 3,026,588 | 3/1962 | Strong | 24/86 R X |
| 3,326,431 | 6/1967 | Belleni | 24/86 R UX |
| 3,535,748 | 10/1970 | Lely | 24/49 CP |

FOREIGN PATENTS OR APPLICATIONS

| | | | |
|---|---|---|---|
| 920,059 | 12/1946 | France | 24/86 R |
| 193,866 | 4/1907 | Germany | 24/85 R |

*Primary Examiner*—Donald A. Griffin

*Attorney, Agent, or Firm*—Zarley, McKee, Thomte & Voorhees

[57] ABSTRACT

A shoulder strap retainer comprising a U-shaped member disposed in a horizontal position and having upper and lower legs. The lower leg is disposed on the shoulder of a garment. At least one post extends from the lower leg through the garment and is received in a clutch retaining means. A shield member having an ornamental upper exterior surface is secured to the upper leg.

1 Claim, 5 Drawing Figures

SHOULDER STRAP RETAINER

BACKGROUND OF THE INVENTION

This invention relates to a shoulder strap retainer in combination with a garment having a shoulder portion whereby the shoulder strap of a handbag or the like disposed over the shoulder portion will be retained thereon and will not slide outwardly off of the shoulder portion as is a common occurrence. Conventional shoulder strap retainers are often integral with the garment and cannot be moved from garment to garment. Furthermore, conventional shoulder strap retainers are often unattractive and are difficult to secure to the shoulder portion of a garment.

Therefore, it is a principal object of the invention to provide an improved shoulder strap retainer.

A further object of the invention is to provide a shoulder strap retainer that can be easily secured to and removed from the shoulder portion of a garment.

A further object of the invention is to provide a shoulder strap retainer which can be easily and quickly secured to or removed from the shoulder of a garment.

A further object of the invention is to provide a shoulder strap retainer which can be secured to and removed from the shoulder portion of a garment without damaging the garment.

A further object of the invention is to provide a shoulder strap retainer which will utilize the weight on the shoulder strap to retain the position of the retainer.

A further object of the invention is to provide a detachable shoulder strap retainer which will normally not move with respect to the garment while it is being used.

A further object of this invention is to provide a shoulder strap retainer which is economical of manufacture, durable in use and refined in appearance.

These and other objects will be apparent to those skilled in the art.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENT

Figure 1:
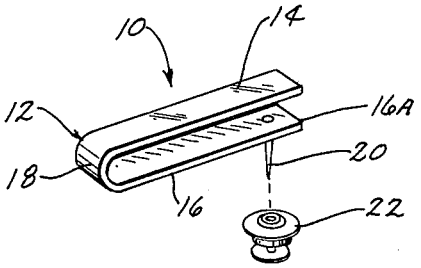
FIG. 1 is a perspective view of the device with the shield member removed therefrom.
Figure 2:
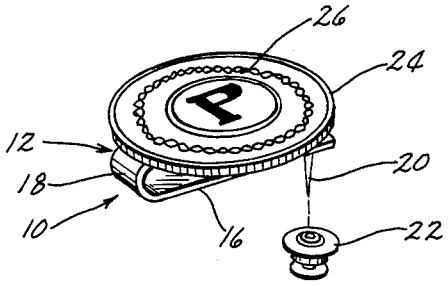
FIG. 2 is a perspective view of the device similar to that of FIG. 1 but with the shield member secured thereon.

The shoulder strap retainer of this invention is generally referred to by the numeral 10 and is comprised of a U-shaped member 12 having an upper leg 14 and a lower leg or base member 16. The upper and lower legs are secured together by a bight or stop member 18. Preferably, the U-shaped member 12 is comprised of a single piece of material.

A post 20 is secured to the base member 16 near the inner end 16A thereof. Post 20 extends downwardly from the base member and the lower end thereof is adapted to be detachably secured at times by clutch member 22.

A shield 24 is secured by welding or the like to the upper surface of upper leg 14. It will be noted in FIG. 4 that the peripheral edges of shield 24 extend beyond the length and width of member 12 to substantially hide the member 12 from view. Preferably, the shield 24 has a decorative or ornamental surface 26 thereon.

Figure 3:
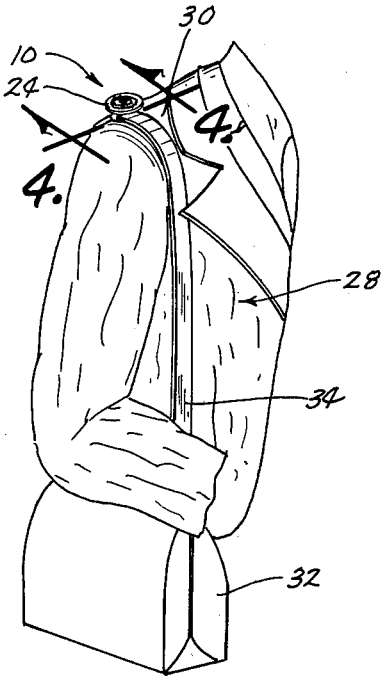
FIG. 3 is a perspective view of the device of FIG. 2 mounted on the shoulder portion of a garment.

A conventional garment or coat 28 is shown in FIG. 3 having a conventional shoulder portion 30. FIG. 3 also illustrates a conventional bag 32 having a conventional shoulder strap 34.

Figure 4:
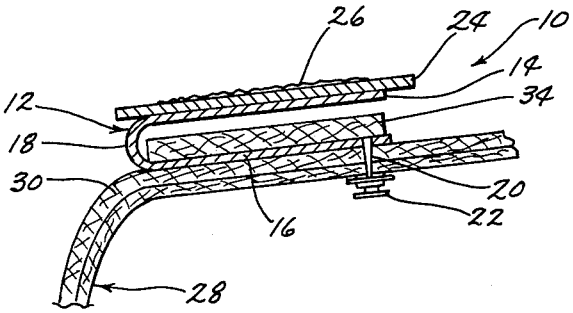
FIG. 4 is a sectional view taken on line 4 — 4 of FIG. 3.
Figure 5:
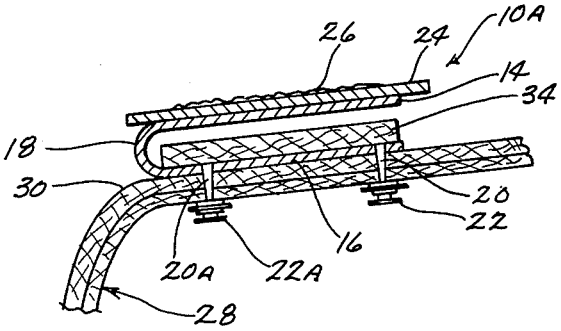
FIG. 5 is a sectional view similar to that of FIG. 4 but showing a slightly modified construction.

A modified form of the invention is shown in FIG. 5. The structure of FIG. 5 is identical to the structure of FIGS. 1 – 4, except that a second post 20A is used in combination with a second clutch member 22A. Post 20A is secured to the outer end of base member 16 and extends downwardly therefrom just as does post 20. The device shown in FIG. 5 is normally used when heavier bags are employed. It will be noted that the lower ends of posts 20 and 20A are slightly sharpened so as to facilitate the penetration thereof through the shoulder portion 30 of the garment 28.

The normal operation of the invention is as follows:

The post 20 is forced through the shoulder portion of the garment, and the clutch member 22 is fixedly attached to the inner end of the post as shown in FIG. 4. The bight 18 of the U-shaped member 12 is disposed in an outwardly direction on the shoulder portion of the garment. The garment is then placed on the person of the wearer, and the shoulder strap 34 is inserted within the U-shaped member 12 so that it rests on the base member 16. Any tendency of the strap to slide outwardly is resisted by both the base member 12 and the bight 18. The shield member 24 serves to hide the structure of member 12 and further serves to maintain the strap 34 within the member 12. The weight exerted on the strap 34 tends to maintain the retainer 10 in the position shown in FIG. 4.

If it is known that the retainer 10 will be used to maintain the strap of a heavy bag, or a bag in which relatively heavy equipment will be carried, the retainer 10A shown in FIG. 5 will be utilized. This retainer is employed in the same manner as retainer 10 except that two posts and two clutches are utilized as described herebefore. It is understood that the post and clutch elements described in this invention are of conventional construction but are unique in the shoulder strap retainer art.

From the foregoing description, it is seen that the device of this invention will achieve at least its stated objectives.

We claim:

1. In combination, a garment having a shoulder portion, said shoulder portion having interior and exterior surfaces and inner and outer portions, and a pivotally mounted self-aligning shoulder strap retaining means secured to the exterior surface of said shoulder portion, said retaining means comprising:

a base member having inner and outer end portions on the exterior surface of said shoulder portion and terminating in a stop means on the outer end thereof, said base member being adapted to engage and hold a strap from movement outwardly from said shoulder portion; the inner and outer ends of said base member being positioned on the inner and outer portions, respectively, of said shoulder portion;

a post means secured to said base member and pivotally extending downwardly through the inner portion of said shoulder portion and through the interior surface of said shoulder portion; said post means being straight and terminating in a sharpened end beyond the interior surface of said shoulder portion;

fastening means on said post means inside said garment underneath said shoulder portion and adjacent the interior surface thereof; and said post means being secured to the inner end of said base member whereby the weight exerted on a shoulder strap held by said stop means will retain the position of said base member on said shoulder portion.

* * * * *